US009111533B2

(12) United States Patent
Shirakawa et al.

(10) Patent No.: US 9,111,533 B2
(45) Date of Patent: Aug. 18, 2015

(54) AUDIO CODING DEVICE, METHOD, AND COMPUTER-READABLE RECORDING MEDIUM STORING PROGRAM

(75) Inventors: Miyuki Shirakawa, Fukuoka (JP); Yohei Kishi, Kawasaki (JP); Masanao Suzuki, Kawasaki (JP); Yoshiteru Tsuchinaga, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 765 days.

(21) Appl. No.: 13/297,536

(22) Filed: Nov. 16, 2011

(65) Prior Publication Data

US 2012/0136657 A1 May 31, 2012

(30) Foreign Application Priority Data

Nov. 30, 2010 (JP) ..... 2010-266492

(51) Int. Cl.

| | |
|---|---|
| ***G10L 19/02*** | (2013.01) |
| ***G10L 19/035*** | (2013.01) |
| *G10L 19/00* | (2013.01) |
| *G10L 19/008* | (2013.01) |

(52) U.S. Cl.

CPC ..... *G10L 19/035* (2013.01); *G10L 19/0204* (2013.01); *G10L 19/008* (2013.01); *G10L 19/0017* (2013.01)

(58) Field of Classification Search

CPC ... G10L 21/04; G10L 19/008; G10L 19/0017; G10L 19/035; H04B 1/665; H04B 1/667

USPC ..... 704/229, 230, 200.1, 500–504, 222, 704/226–228, 219, 224, 205, 203; 375/240–245, 260

See application file for complete search history.

(56) References Cited

U.S. PATENT DOCUMENTS

| | | | | |
|---|---|---|---|---|
| 5,241,603 | A * | 8/1993 | Akagiri et al. | 704/205 |
| 5,761,642 | A | 6/1998 | Suzuki et al. | |
| 5,870,703 | A * | 2/1999 | Oikawa et al. | 704/200.1 |
| 6,138,093 | A * | 10/2000 | Ekudden et al. | 704/228 |
| 6,169,973 | B1 * | 1/2001 | Tsutsui et al. | 704/500 |
| 6,487,535 | B1 * | 11/2002 | Smyth et al. | 704/500 |
| 6,823,310 | B2 * | 11/2004 | Ishito et al. | 704/270 |
| 7,142,559 | B2 * | 11/2006 | Choi et al. | 370/466 |
| 8,019,601 | B2 * | 9/2011 | Eguchi | 704/230 |
| 2005/0157884 | A1 * | 7/2005 | Eguchi | 381/23 |

(Continued)

FOREIGN PATENT DOCUMENTS

| | | | |
|---|---|---|---|
| JP | 6-268608 | A | 9/1994 |
| JP | 2007-183528 | A | 7/2007 |
| JP | 2008-224902 | A | 9/2008 |

*Primary Examiner* — Vijay B Chawan

(74) *Attorney, Agent, or Firm* — Oblon, McClelland, Maier & Neustadt, L.L.P.

(57) ABSTRACT

An audio coding device includes a time-to-frequency converter that performs time-to-frequency conversion on each frame of a signal in at least one channel included in an audio signal in a predetermined length of time in order to convert the signal in the at least one channel to a frequency signal; a complexity calculator that calculates complexity of the frequency signal for each of the at least one channel. The audio further includes a bit allocation controller that determines a number of bits to be allocated to each of at least one channel so that more bits are allocated to the each of the at least one channel as the complexity of the each of at least one channel increases, and increases the number of bits to be allocated as an estimation error in the number; and a coder that codes the frequency signal.

19 Claims, 11 Drawing Sheets

(56) References Cited

U.S. PATENT DOCUMENTS

| | | | | |
|---|---|---|---|---|
| 2008/0077413 | A1* | 3/2008 | Eguchi | 704/500 |
| 2008/0219344 | A1 | 9/2008 | Suzuki et al. | |
| 2009/0067634 | A1* | 3/2009 | Oh et al. | 381/17 |
| 2010/0106511 | A1* | 4/2010 | Shirakawa et al. | 704/500 |
| 2010/0169080 | A1* | 7/2010 | Tsuchinaga et al. | 704/200.1 |
| 2011/0002266 | A1* | 1/2011 | Gao | 370/328 |
| 2011/0178806 | A1* | 7/2011 | Shirakawa et al. | 704/500 |
| 2012/0078640 | A1* | 3/2012 | Shirakawa et al. | 704/500 |
| 2012/0224703 | A1* | 9/2012 | Kishi et al. | 381/23 |
| 2013/0054253 | A1* | 2/2013 | Shirakawa et al. | 704/500 |

* cited by examiner

AUDIO CODING DEVICE, METHOD, AND COMPUTER-READABLE RECORDING MEDIUM STORING PROGRAM

CROSS-REFERENCE TO RELATED APPLICATION

This application is based upon and claims the benefit of priority of the prior Japanese Patent Application No. 2010-266492, filed on Nov. 30, 2010, the entire contents of which are incorporated herein by reference.

FIELD

The embodiments disclosed herein relate to an audio coding device, an audio coding method, and an audio coding computer program.

BACKGROUND

Audio signal coding methods used to reduce the amount of audio signal data have been developed. In these coding methods, because of restrictions on data transfer rates and the like, the number of available bits may be predetermined for each frame of coded audio signals. As for an audio coding device, therefore, it is preferable to appropriately allocate available bits for each channel or each frequency band of the audio signal. With the technology disclosed in Japanese Laid-open Patent Publication No. 6-268608, if the number of bits allocated for each channel or each frequency band is not appropriate, sound quality may be largely deteriorated in some channels because, for example, bits allocated to these channels are insufficient. To cope with this, technology to allocate bits of adaptably coded data to an audio signal to be coded has been proposed.

An error caused in a compressing process is calculated from compressed data, decompressed data, and input data, and the number of bits to be apportioned to, for example, each frequency band is corrected according to the error.

SUMMARY

In accordance with an aspect of the embodiments, an audio coding device includes a time-to-frequency converter that performs time-to-frequency conversion on each frame of a signal in at least one channel included in an audio signal in a predetermined length of time in order to convert the signal in the at least one channel to a frequency signal; a complexity calculator that calculates complexity of the frequency signal for each of the at least one channel; a bit allocation controller that determines a number of bits to be allocated to each of the at least one channel so that more bits are allocated to each of the at least one channel as the complexity of the each of the at least one channel increases, and increases the number of bits to be allocated as an estimation error in the number of bits to be allocated with respect to a number of non-adjusted coded bits increases when the frequency signal is coded so that reproduced sound quality of a previous frame meets a prescribed criterion; and a coder that codes the frequency signal in each channel so that the number of bits to be allocated to each channel is not exceeded.

The object and advantages of the invention will be realized and attained by at least the features, elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which.

DESCRIPTION OF EMBODIMENTS

Audio coding devices in various embodiments will be described with reference to the drawings. Each of these audio coding devices determines the number of bits allocated for each channel of an audio signal to be coded, according to the complexity of the signal in the channel. In the allocation of bits, the audio coding device calculates, for each channel, an estimation error in the number of preallocated bits with respect to the number of bits used to code a signal so that the quality of reproduced sound meets a prescribed criterion, the number of the preallocated bits having been calculated for an already coded frame. The audio coding device allocates more bits to the next frame as the channel has a larger estimation error.

There is no limit on the number of channels that are included in the audio signal to be coded; the audio signal to be coded may be a monaural signal, a stereo signal, or 3.1- or 5.1-channel audio signal, for example. In the embodiments described below, the audio signal to be coded has N channels (N is an integer equal to or grater than 1).

Figure 1:
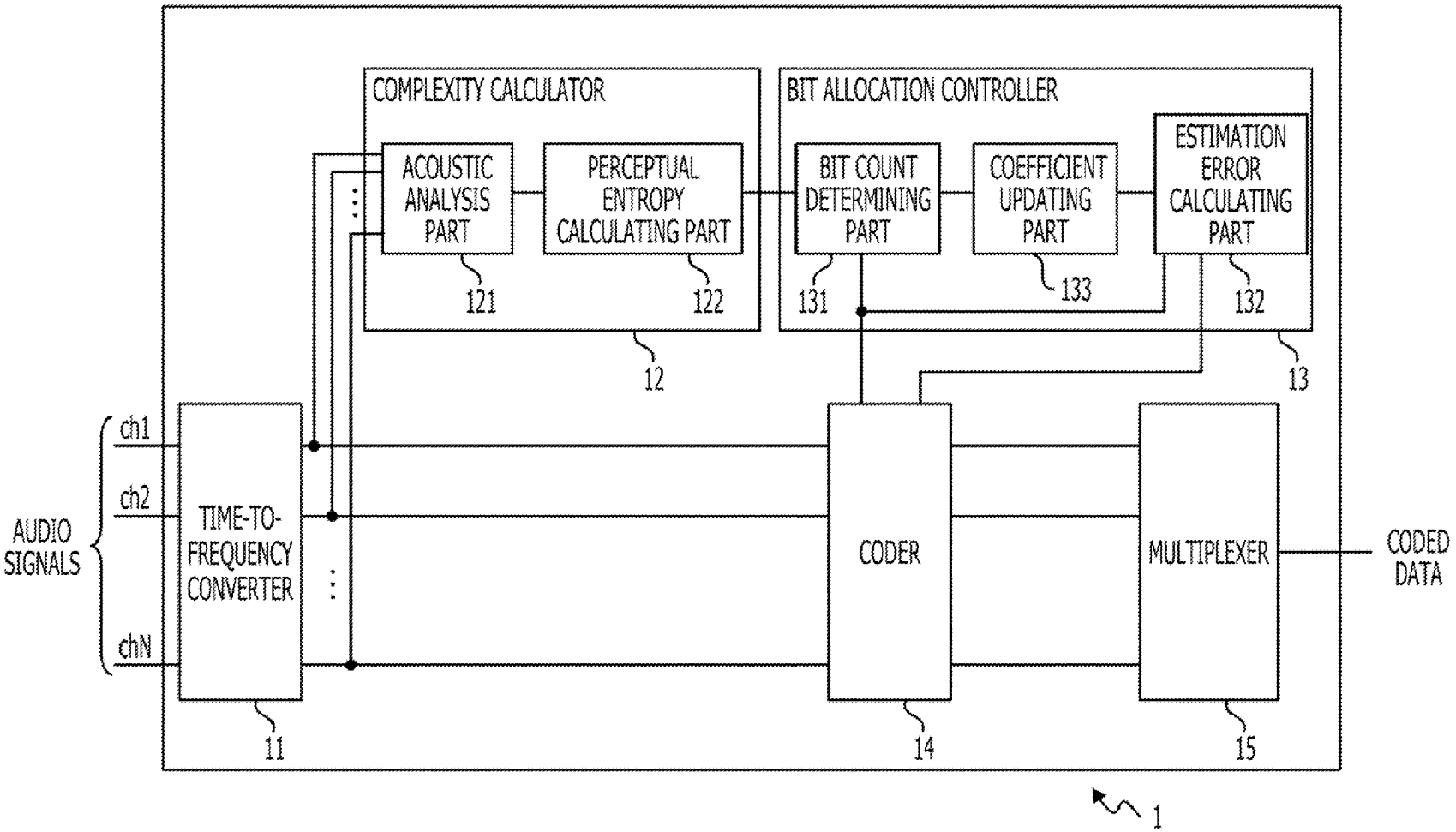
FIG. 1 schematically shows the structure of an audio coding device in a first embodiment.

FIG. 1 schematically shows the structure of an audio coding device in a first embodiment. As depicted in FIG. 1, the audio coding device 1 has a time-to-frequency converter 11, a complexity calculator 12, a bit allocation controller 13, a coder 14, and a multiplexer 15.

These components of the audio coding device 1 may each be formed as a separate circuit. Alternatively, circuits corresponding to these components of the audio coding device 1 may be integrated into one circuit and the one integrated circuit may be mounted in the audio coding device 1. Alternatively, these components of the audio coding device 1 may be functional modules implemented by a computer program executed by a processor provided in the audio coding device 1.

The time-to-frequency converter 11 performs, for each frame, time-to-frequency conversion on a signal in each channel in a time domain of an audio signal received by the audio coding device 1 to a frequency signal. In this embodiment, the time-to-frequency converter 11 performs the fast Fourier transform to covert the signal in each channel to a frequency signal. An equation to convert a signal $X_{ch}(t)$ in the time domain of a channel ch in a frame t to a frequency signal is represented below.

$$spec_{ch}(t)_i = \sum_{k=0}^{S-1} X_{ch}(t)_k \exp\left(-j\frac{2\pi \cdot i \cdot k}{S}\right),\ i = 0, \ldots, S-1 \tag{1}$$

where k, which is a variable indicating a time, indicates a k-th time when an audio signal for one frame is equally divided into S segments in the time direction. The frame length can take any value in a range of 10 ms to 80 ms, for example. In the equation, i, which is a variable indicating a frequency, indicates an i-th frequency when the entire frequency band is equally divided into S segments. S is set to 1024, for example. In the equation, $spec_{ch}(t)_i$ is an i-th frequency signal in the channel ch in the frame t. The time-to-frequency converter 11 may convert the signal in the time domain of each channel to a frequency signal by using the discrete cosine transform, modified discrete cosine transform, quadrature mirror filter (QMF) filter bank, or another time-to-frequency conversion process.

Each time the frequency signal in a channel is calculated for each frame, the time-to-frequency converter 11 outputs the frequency signal in the channel to the complexity calculator 12 and coder 14.

The complexity calculator 12 calculates a complexity of the frequency signal in each channel for each frame, the complexity being an index used to determine the number of bits allocated to the channel. In this embodiment, therefore, the complexity calculator 12 includes an acoustic analysis part 121 and a perceptual entropy calculating part 122.

The acoustic analysis part 121 divides the frequency signal in each channel into a plurality of bands, each of which has a predetermined bandwidth, for each frame, and calculates a spectral power and a masking threshold for each band. Accordingly, the acoustic analysis part 121 can use the method described in, for example, C.1 in Annex C, "Psychoacoustic Model" in ISO/IEC 13818-7:2006, which is one of the international standards jointly established by the International Organization for Standardization (ISO) and International Electrotechnical Commission (IEC).

The acoustic analysis part 121 calculates the spectral power of each band according to, for example, the equation indicated below.

$$specPow_{ch}[b](t) = \sum_{i}^{bw[b]} spec_{ch}(t)_i^2 \tag{2}$$

where $specPow_{ch}[b](t)$ is the spectral power of a frequency band b in the channel ch in the frame t, and bw[b] is the bandwidth of the frequency band b.

The acoustic analysis part 121 calculates a masking threshold that represents the power of a lower limit frequency signal of a sound that a listener can hear. For example, the acoustic analysis part 121 may output a value predetermined for each frequency band as the masking threshold. Alternatively, the acoustic analysis part 121 calculates the masking threshold according to the acoustic property of the people. In this case, the masking threshold for the frequency band of interest in the frame to be coded is increased as the spectral power in the same frequency band in a frame following the frame to be coded and spectral power of the adjacent frequency bands in the frame to be coded become larger.

The acoustic analysis part 121 can calculate the masking threshold according to the threshold calculating process (the threshold is equivalent to the masking threshold) described in C.1.4, "Steps in Threshold Calculation" in C.1 in Annex C, "Psychoacoustic Model" in ISO/IEC 13818-7:2006. In this case, the acoustic analysis part 121 calculates the masking threshold by using the frequency signals in the frame immediately following the frame to be coded and in the second previous frame. Thus, the acoustic analysis part 121 has a memory circuit to store the frequency signals in the frame immediately after the frame to be coded and the second previous frame as well.

Alternatively, the acoustic analysis part 121 may calculate the masking threshold as described in 5.4.2, "Threshold Calculation" in the Third Generation Partnership Project (3GPP) TS 26.403 V9.0.0. In this case, the acoustic analysis part 121 calculates the masking threshold by, for example, correcting a threshold obtained as a ratio of the spectral power in each frequency band to a signal-to-noise ratio with voice diffusion, pre-echo, and the like taken into consideration. The acoustic analysis part 121 outputs, to the perceptual entropy calculating part 122, the spectral power in each frequency band and the masking threshold for each channel in each frame.

The perceptual entropy calculating part 122 calculates, as the index representing complexity, a perceptual entropy (PE) from, for example, the equation given below for each channel in each frame. The PE value represents the amount of information required to quantize a frame so as to prevent a listener from perceiving noise.

$$PE_{ch}(t) -= \sum_{b=0}^{E-1} bw[b] * \log_{10}(maskPow_{ch}[b](t) / specPow_{ch}[b](t)) \tag{3}$$

where $specPow_{ch}[b](t)$ and $maskPow_{ch}[b](t)$ are respectively the spectral power and masking threshold of the frequency band b of the channel ch in the frame t; bw[b] is the bandwidth of the frequency band b; B is the total number of frequency bands into which the entire frequency spectrum is divided; $PE_{ch}(t)$ is the PE value of the channel ch in the frame t. The perceptual entropy calculating part 122 outputs the PE value calculated for each frame to the bit allocation controller 13.

The bit allocation controller 13 determines the number of bits to be allocated, which is the upper limit for the number of bits in a coded frequency signal to be allocated to a channel, and notifies the coder 14 of the determined number of bits to be allocated. Thus, the bit allocation controller 13 has a bit count determining part 131, an estimation error calculating part 132, and a coefficient updating part 133.

The bit count determining part 131 determines, for each channel, the number of bits to be allocated according to an estimation equation that represents the relation between complexity and the number of bits to be allocated. In this embodiment, an equation that represents the relation between the PE value, which is an example of complexity, and the number of bits to be allocated is represented as follows.

$$p\mathrm{Bit}_{ch}(t)=\alpha_{ch}(t)\times PE_{ch}(t) \quad (4)$$

where $PE_{ch}(t)$ is the PE value of the channel ch in the frame t; $\alpha_{ch}(t)$ is the estimation coefficient for the channel ch in the frame t, $\alpha_{ch}(t)$ having a positive value. Therefore, as the complexity of the frequency signal in a channel becomes higher, the bit count determining part 131 increases the number of bits to be allocated to the channel. $\alpha_{ch}(t)$ is set for each channel and its value is updated by the coefficient updating part 133 as described later.

The bit count determining part 131 stores the estimation coefficient of each channel in a memory such as a semiconductor memory provided in the bit count determining part 131. The bit count determining part 131 uses the estimation coefficient to obtain the number of bits to be allocated to each channel for each frame and notifies the coder 14 and estimation error calculating part 132 of the number of bits to be allocated.

For a frame a prescribed number of frames following the frame to be coded, the estimation error calculating part 132 calculates, for each channel, estimation error in the number of bits to be allocated with respect to the number of non-adjusted coded bits, which is the number of bits that have been required to code the frequency signal so that its sound quality meets a prescribed criterion. The estimation error is not known until an audio signal is actually coded. For example, the estimation error calculating part 132 can calculate the estimation error according to the following equation.

$$\mathrm{diff}_{ch}(t)=r\mathrm{Bit}_{ch}(t-1)-p\mathrm{Bit}_{ch}(t-1) \quad (5)$$

where $p\mathrm{Bit}_{ch}(t-1)$ is the number of bits to be allocated to the channel ch in the frame (t−1) immediately following the frame t to be coded; $r\mathrm{Bit}_{ch}(t-1)$ is the number of non-adjusted coded bits in the channel ch in the frame (t−1), and $\mathrm{diff}_{ch}(t)$ is the estimation error for the channel ch, which has been calculated for the frame t to be coded.

Alternatively, the estimation error calculating part 132 may calculate the estimation error for the channel ch according to the following equation.

$$\mathrm{diff}_{ch}(t)=r\mathrm{Bit}_{ch}(t-1)/p\mathrm{Bit}_{ch}(t-1) \quad (6)$$

The estimation error calculating part 132 notifies the coefficient updating part 133 of the estimation error and the number of non-adjusted coded bits in each channel.

The coefficient updating part 133 determines whether to update the estimation coefficient according to the estimation error in each channel. If the estimation error is to be updated, the coefficient updating part 133 corrects the estimation coefficient so as to reduce the estimation error. If, for example, the estimation error $\mathrm{diff}_{ch}(t)$ for the channel ch is continuously outside a prescribed allowable error range over a prescribed period Tth, the coefficient updating part 133 corrects the estimation coefficient for the channel ch. The prescribed period Tth is set to, for example, a period during which a listener cannot perceive the deterioration of reproduced sound quality, which is caused by an inappropriate number of allocated bits, the period being the length of one to five frames, for example. If, for example, an audio signal to be coded is sampled at a frequency of 48 kHz and 1024 sampling points are included in one frame, the period Tth is equivalent to about 20 ms to about 100 ms.

If, for example, the estimation error $\mathrm{diff}_{ch}(t)$ has been calculated as the difference between $r\mathrm{Bit}_{ch}(t-1)$ and $p\mathrm{Bit}_{ch}(t-1)$ according to equation (5), the allowable error range is a range in which the absolute value of the estimation error $\mathrm{diff}_{ch}(t)$ is equal to or less than a threshold Diffth. In this case, the threshold Diffth is set to any value of about 100 to about 500, for example. If the estimation error $\mathrm{diff}_{ch}(t)$ has been set as the ratio between $r\mathrm{Bit}_{ch}(t-1)$ and $p\mathrm{Bit}_{ch}(t-1)$ according to equation (6), the allowable error range is within a range of (1−Diffth) to (1+Diffth). In this case, the threshold Diffth is set to any value of about 0.1 to about 0.5, for example.

If the estimation error $\mathrm{diff}_{ch}(t)$ for the channel ch is continuously outside the allowable error range for a prescribed period or longer, the coefficient updating part 133 corrects the estimation coefficient for the channel ch so as to reduce the estimation error, for example, according to the following equation.

$$\alpha_{ch}(t)=\mathrm{CorFac}_{ch}(t)\times\alpha_{ch}(t-1) \quad (7)$$

where $\alpha_{ch}(t)$ is the estimation coefficient for the channel ch in the frame t to be coded, and $\alpha_{ch}(t-1)$ is the estimation coefficient for the channel ch in the frame (t−1) immediately following the frame t to be coded. $\mathrm{CorFac}_{ch}(t)$ is a gradient correction coefficient, the value of which is obtained from, for example the following equation.

$$CorFac_{ch}(t)=\frac{rBit_{ch}(t-1)}{pBit_{ch}(t-1)} \quad (8)$$

Alternatively, to prevent the estimation coefficient from abruptly changing, the coefficient updating part 133 may smooth the gradient correction coefficient $\mathrm{CorFac}_{ch}(t)$, which is calculated according to equation (8), by using a decreasing coefficient and a gradient correction coefficient $\mathrm{CorFac}_{ch}(t-1)$ for the frame immediately following the frame to be coded.

$$\mathrm{CorFac}_{ch}(t)=p\cdot\mathrm{CorFac}_{ch}(t-1)+(1-p)\mathrm{CorFac}_{ch}(t) \quad (9)$$

where p is the decreasing coefficient, which is set to any value of 0 to 0.8, for example. As is clear from equation (9), the larger the value of p, the more gentle the change of the gradient correction coefficient is.

When the estimation error is not outside the allowable error range or a period during which the estimation error is outside the allowable range is shorter than the prescribed period described above, the coefficient updating part 133 uses the estimation coefficient $\alpha_{ch}(t-1)$ for the frame immediately following the frame to be coded as the estimation coefficient $\alpha_{ch}(t)$ for the frame to be coded. The coefficient updating part 133 notifies the bit count determining part 131 of the estimation coefficient $\alpha_{ch}(t)$ for each channel in each frame.

Figure 2:
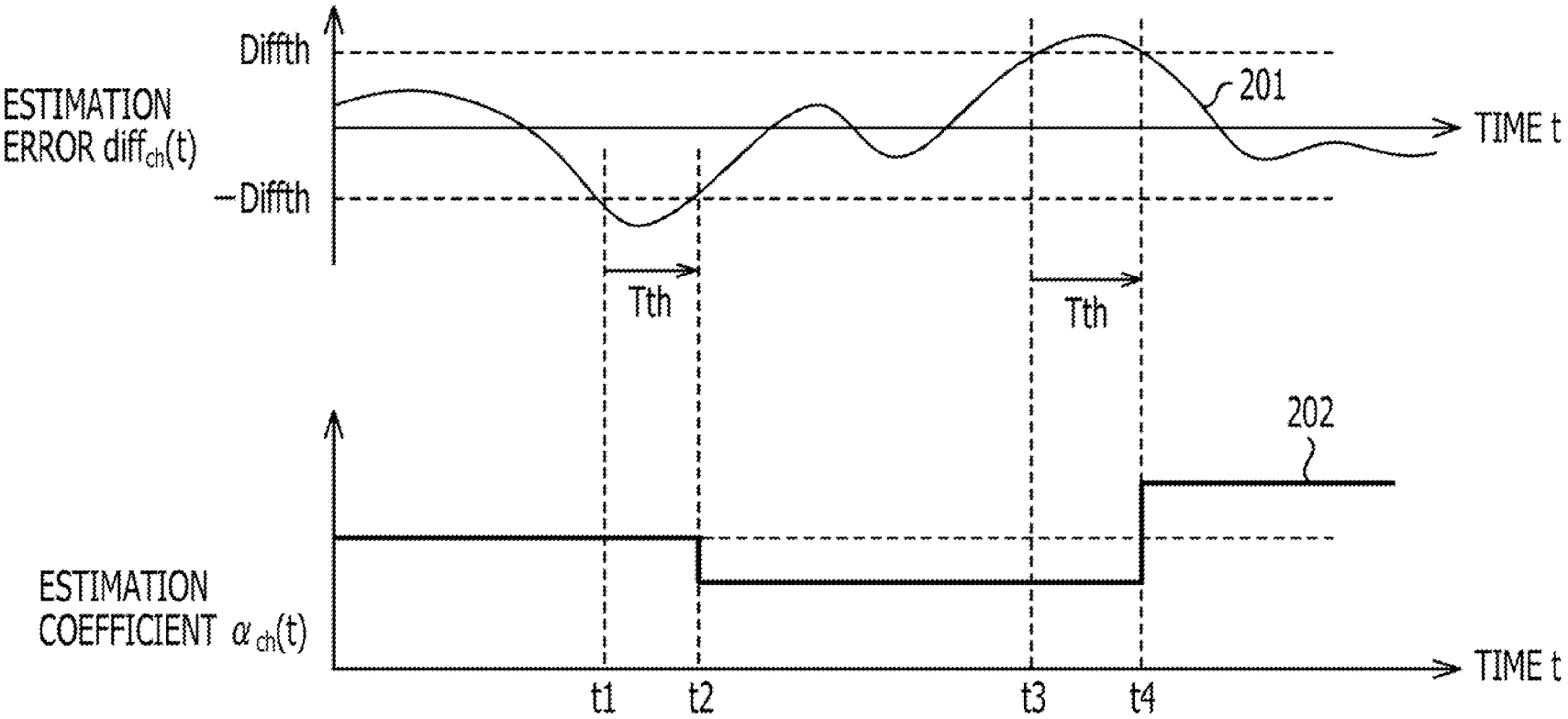
FIG. 2 illustrates examples of changes of estimation error and of the value of an estimation coefficient with time.

FIG. 2 illustrates examples of changes of an estimation error and of the value of the estimation coefficient with time. The upper graph 201 in FIG. 2 represents a change of estimation error with time, the lower graph 202 represents a change of the value of the estimation coefficient with time. The horizontal axes of these graphs are time. The vertical axis of the upper graph 201 represents the value of the estimation error $\mathrm{diff}_{ch}(t)$, and the vertical axis of the lower graph 202 represents the value of the estimation coefficient $\alpha_{ch}(t)$. In this example, the estimation error is assumed to have been calculated according to equation (5).

As illustrated in FIG. 2, the estimation error is lower than the threshold −Diffth during the period Tth starting from time t1. That is, during the period, the number of bits that have been allocated to the channel ch is larger than the number of bits that are actually needed. Accordingly, the estimation coefficient $\alpha_{ch}(t)$ is corrected to a value less than the values of the previous estimation coefficients at time t2 at which the period Tth starting from time t1 expires so that the number of bits to be allocated to the channel ch is reduced. The estimation error is within the allowable range during the period from time t2 to time t3, so the estimation coefficient is not corrected until time t3. The estimation coefficient exceeds the threshold Diffth during another period Tth starting from time t3. That is, during the period, the number of bits that have been allocated to the channel ch is less than the number of bits that are actually needed. Accordingly, the estimation coefficient $\alpha_{ch}(t)$ is corrected to a value larger than the values of the previous estimation coefficients at time t4 at which the period Tth starting from time t3 expires so that the number of bits to be allocated to the channel ch is increased.

Figure 3:
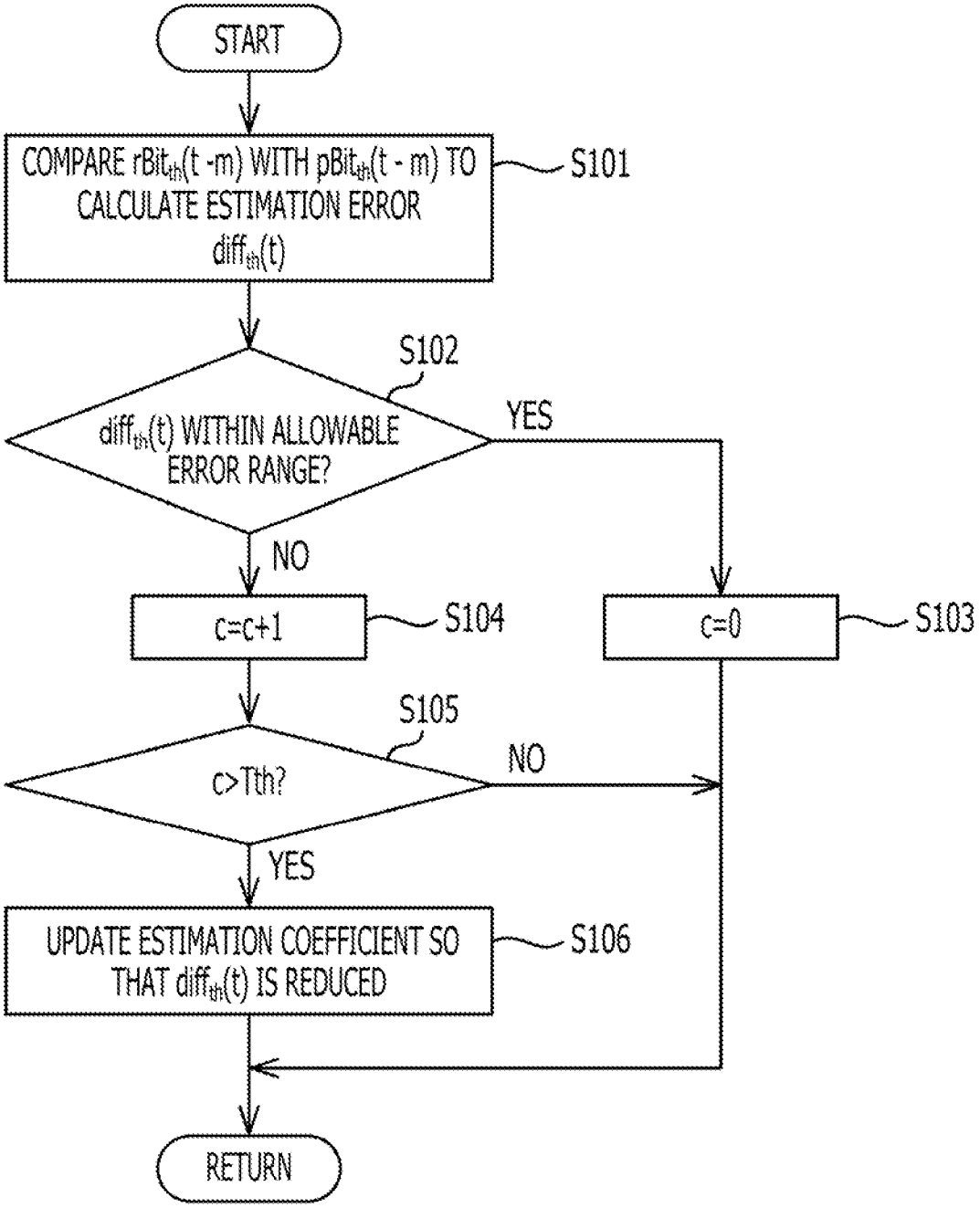
FIG. 3 is a flowchart illustrating the operation of an estimation coefficient update process.

FIG. 3 is a flowchart illustrating the operation of an estimation coefficient update process executed by the bit allocation controller 13. The bit allocation controller 13 updates the estimation coefficient for each channel in each frame, according to this operation flowchart. The estimation error calculating part 132 in the bit allocation controller 13 compares the number $rBit_{ch}(t-1)$ of non-adjusted coded bits in the frame (t−1) immediately following the frame t to be coded with the number $pBit_{ch}(t-1)$ of bits to be allocated to calculate the estimation error $diff_{ch}(t)$ (operation S101). The estimation error calculating part 132 then notifies the coefficient updating part 133 in the bit allocation controller 13 of the calculated estimation error $diff_{ch}(t)$.

The coefficient updating part 133 determines whether the estimation error $diff_{ch}(t)$ is within the allowable error range (operation S102). If the estimation error $diff_{ch}(t)$ is within the allowable error range (the result in operation S102 is Yes), the coefficient updating part 133 resets a counter c, which indicates a period during which the estimation error $diff_{ch}(t)$ exceeds the allowable error range, to 0 (operation S103). The coefficient updating part 133 then terminates the process to update the estimation coefficient without updating the estimation coefficient.

If the estimation error $diff_{ch}(t)$ is outside the allowable error range (the result in operation S102 is No), the coefficient updating part 133 increments the counter c by one (operation S104). The coefficient updating part 133 then determines whether the counter c has reached the period Tth (operation S105). If the counter c has not reached the period Tth (the result in operation S105 is No), the coefficient updating part 133 terminates the process to update the estimation coefficient without updating the estimation coefficient. If the counter c has reached the period Tth (the result in operation S105 is Yes), the coefficient updating part 133 updates the estimation coefficient so that estimation error $diff_{ch}(t)$ is reduced (operation S106). The coefficient updating part 133 then terminates the process to update the estimation coefficient.

The coder 14 encodes the frequency signal of each channel output from the time-to-frequency converter 11 so that the number of bits to be allocated is not exceeded, which has been determined by the bit allocation controller 13. In this embodiment, the coder 14 quantizes a frequency signal for each channel and entropy-encodes the quantized frequency signal.

Figure 4:
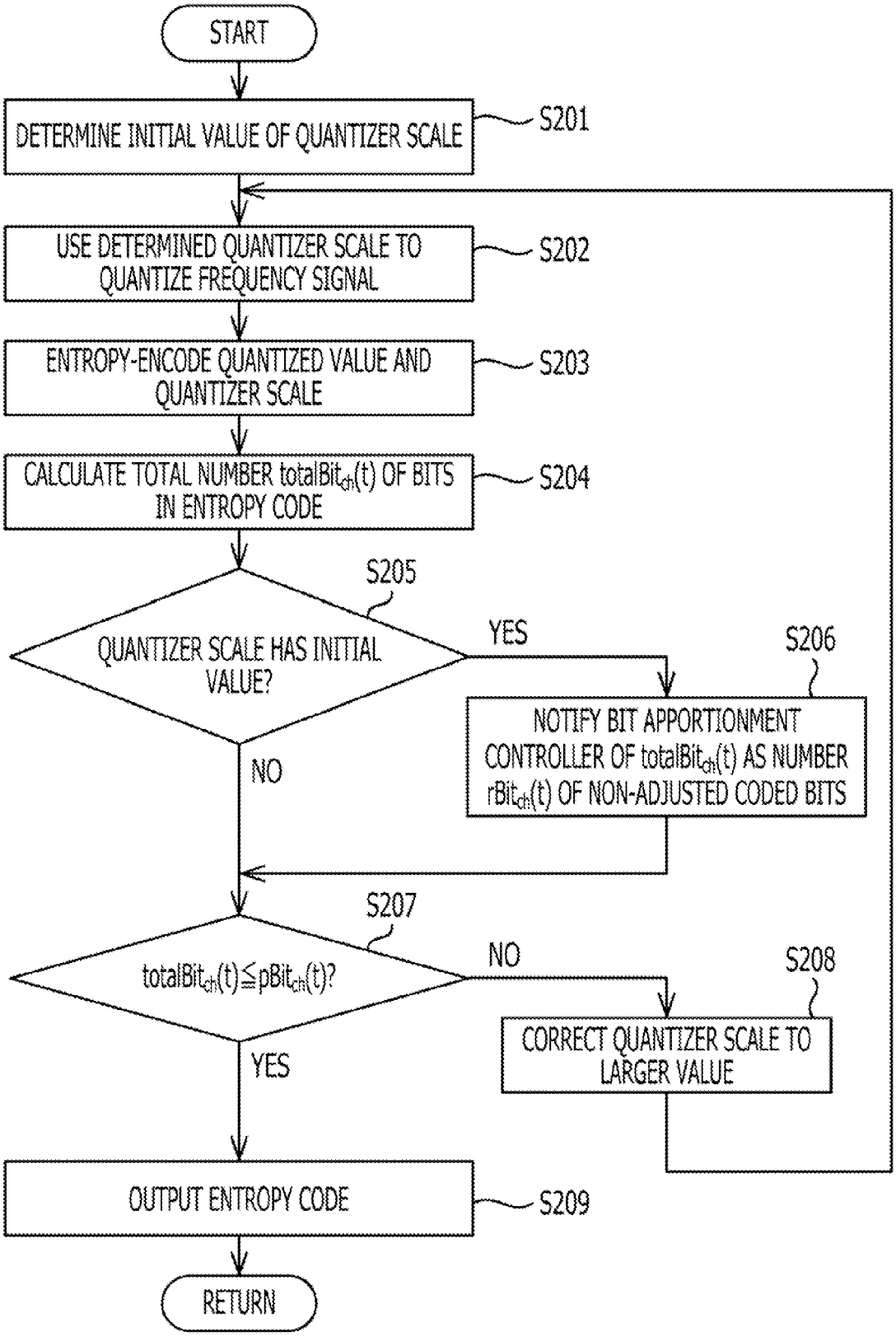
FIG. 4 is a flowchart illustrating the operation of a frequency signal coding process.

FIG. 4 is a flowchart illustrating the operation of a frequency signal coding process executed by the coder 14. The coder 14 encodes a frequency signal for each channel in each frame, according to this operation flowchart. The coder 14 firsts determines the initial value of a quantizer scale, which stipulates a quantization width in the quantization of each frequency signal (operation S201). For example, the coder 14 determines the initial value of the quantizer scale so that the quality of reproduced sound meets a prescribed criterion. To determine the value of the quantizer scale, the coder 14 can use the method described in, for example, Annex C in ISO/IEC 13818-7:2006 or 5.6.2.1 in 3GPP TS26.403. If the method described in 5.6.2.1 in 3GPP TS26.403 is used, for example, the coder 14 determines the initial value of the quantizer scale according to the following equations.

$$scale_{ch}[b](t) = \text{floor}(8.8585 \cdot (\log_{10}(6.75 \cdot maskPow_{ch}[b](t)) - \log_{10}(ffac[b](t)))) \tag{10}$$

$$ffac[b](t) = \sum_{i}^{bw[b]} \sqrt{|spec_{ch}(t)_i|}$$

where $scale_{ch}[b](t)$ and mask $Pow_{ch}[b](t)$ are respectively the initial value and masking threshold of the quantizer scale in the frequency band b in the channel ch in the frame t. In these equations, bw[b] represents the bandwidth of the frequency band b, $spec_{ch}(t)1$ is the i-th frequency signal in the channel ch in the frame t. The floor function floor(x) returns the maximum integer that does not exceed the value of a variable x.

The coder 14 then uses the determined quantizer scale to quantize the frequency signal according to, for example, the following equation (operation S202).

$$quant_{ch}(t)_i = \text{sign}(spec_{ch}(t)_i) \cdot \text{int}(spec_{ch}(t)_i|^{0.75} \cdot 2^{-0.1875 \cdot scale_{ch}[b](t)} + 0.4054) \tag{11}$$

where $quant_{ch}(t)1$ is a quantized value of the i-th frequency signal in the channel ch in the frame t, and $scale_{ch}[b](t)i$ is a quantizer scale calculated for the frequency band in which the i-th frequency signal is included.

The coder 14 entropy-encodes the quantized value and quantizer scale of the frequency signal in each channel by using entropy coding such as Huffman coding or arithmetic coding (operation S203). The coder 14 then calculates the total number $totalBit_{ch}(t)$ of bits in the entropy-coded quantized value and quantizer scale (operation S204). The coder 14 determines whether the quantizer scale, which has been used to quantize the frequency signal, has its initial value (operation S205). If the value of the quantizer scale is its initial value (the result in operation S205 is Yes), the coder 14 notifies the bit allocation controller 13 of the total number $totalBit_{ch}(t)$ of bits in the entropy code as the number $rBit_{ch}(t)$ of non-adjusted coded bits (operation S206).

After operation S206 has been completed or if the value of the quantizer scale is not the initial value in operation S205 (the result in operation S205 is No), the coder 14 determines whether the total number $totalBit_{ch}(t)$ of bits in the entropy code is equal to or less than the number $pBit_{ch}(t)$ of bits to be allocated (operation S207). If $totalBit_{ch}(t)$ is greater than the number $pBit_{ch}(t)$ of bits to be allocated (the result in operation S207 is No), the coder 14 corrects the quantizer scale so that its value is increased (operation S208). For example, the coder 14 doubles the value of the quantizer scale provided for each frequency band. The coder 14 then reexecutes the processes in operation S202 and later.

If the total number $totalBit_{ch}(t)$ of bits in the entropy code is equal to or less than the number $pBit_{ch}(t)$ of bits to be allocated (the result in operation S207 is Yes), the coder 14 outputs the entropy code to the multiplexer 15 as coded data for the channel (operation S209). The coder 14 then terminates the process to code the frequency signal in the channel.

The coder 14 may use another coding method. For example, the coder 14 may code the frequency signal in each channel according to the advanced audio coding (MC) method. In this case, the coder 14 can use technology disclosed in, for example, Japanese Laid-open Patent Publication No. 2007-183528. Specifically, the coder 14 calculates the PE value or receives the PE value from the complexity calculator 12. The PE value becomes large for an attack sound produced from a percussion instrument or another sound the signal level of which changes in a short time. Accordingly, the coder 14 shortens a window for a frame in which the value of PE becomes relatively large and prolongs a window for a block in which the value of PE becomes relatively small. For example, a short window includes 256 samples and a long window includes 2048 samples. The coder 14 tentatively performs frequency-to-time conversion on the frequency signal in each channel by reversing the time-to-frequency conversion, which has been used in the time-to-frequency converter 11. The coder 14 then uses a window having a determined length to perform modified discrete cosine transform (MDCT) on the stereo signal in each channel to convert the signal in each channel to an MDCT coefficient group. The coder 14 quantizes the MDCT coefficient group with the quantizer scale described above and entropy-codes the quantized MDCT coefficient group. In this case, the coder 14 adjusts the quantizer scale until the number of bits to be coded in each channel is reduced to or below the number of bits to be allocated.

The coder 14 may code a high-frequency component of the frequency signal, which is included in a high-frequency band, for each channel according to the spectral band replication (SBR) method. For example, the coder 14 reproduces a low-frequency component of the frequency signal, in each channel, which is strongly correlated to a high-frequency component to be subject to SBR coding, as disclosed Japanese Laid-open Patent Publication No. 2008-224902. The low-frequency component is a frequency signal, in a channel, included in the low-frequency band lower than the high-frequency band in which a high-frequency component to be coded by the coder 14 is included. The low-frequency component is coded according to, for example, the above-mentioned AAC method. The coder 14 then adjusts the power of the reproduced high-frequency component so that it matches the power of the original high-frequency component. The coder 14 uses, as auxiliary information, the original high-frequency component if it has a large difference from the low-frequency component and a reproduced low-frequency component cannot approximate the high-frequency component. The coder 14 then quantizes information representing a positional relation between the low-frequency component used for reproduction and its corresponding high-frequency component, the amount of power adjustment, and the auxiliary information to perform coding. In this case as well, the coder 14 adjusts the quantizer scale used to quantize the low-frequency component signal and the quantizer scale for the auxiliary information and an amount by which power is adjusted until the number of bits to be coded in each channel is reduced to or below the number of bits to be allocated. The coder 14 may use another coding method that can compress the amount of data, instead of entropy-coding quantized frequency signals or the like.

Figure 5:
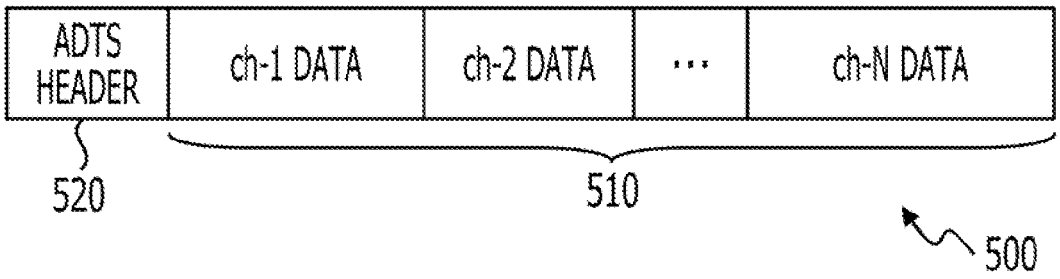
FIG. 5 illustrates an example of the format of data storing a coded audio signal.

The multiplexer 15 arranges the entropy code created by the coder 14 in a predetermined order to perform multiplexing. The multiplexer 15 then outputs a coded audio signal resulting from the multiplexing. FIG. 5 illustrates an example of the format of data storing a coded audio signal. In this example, the coded audio signal is created according to the MPEG-4 audio data transport stream (ADTS) format. In the coded data string 500 illustrated in FIG. 5, the entropy code in each channel is stored in the data block 510. Header information 520 in the ADTS format is stored in front of the data block 510.

Figure 6:
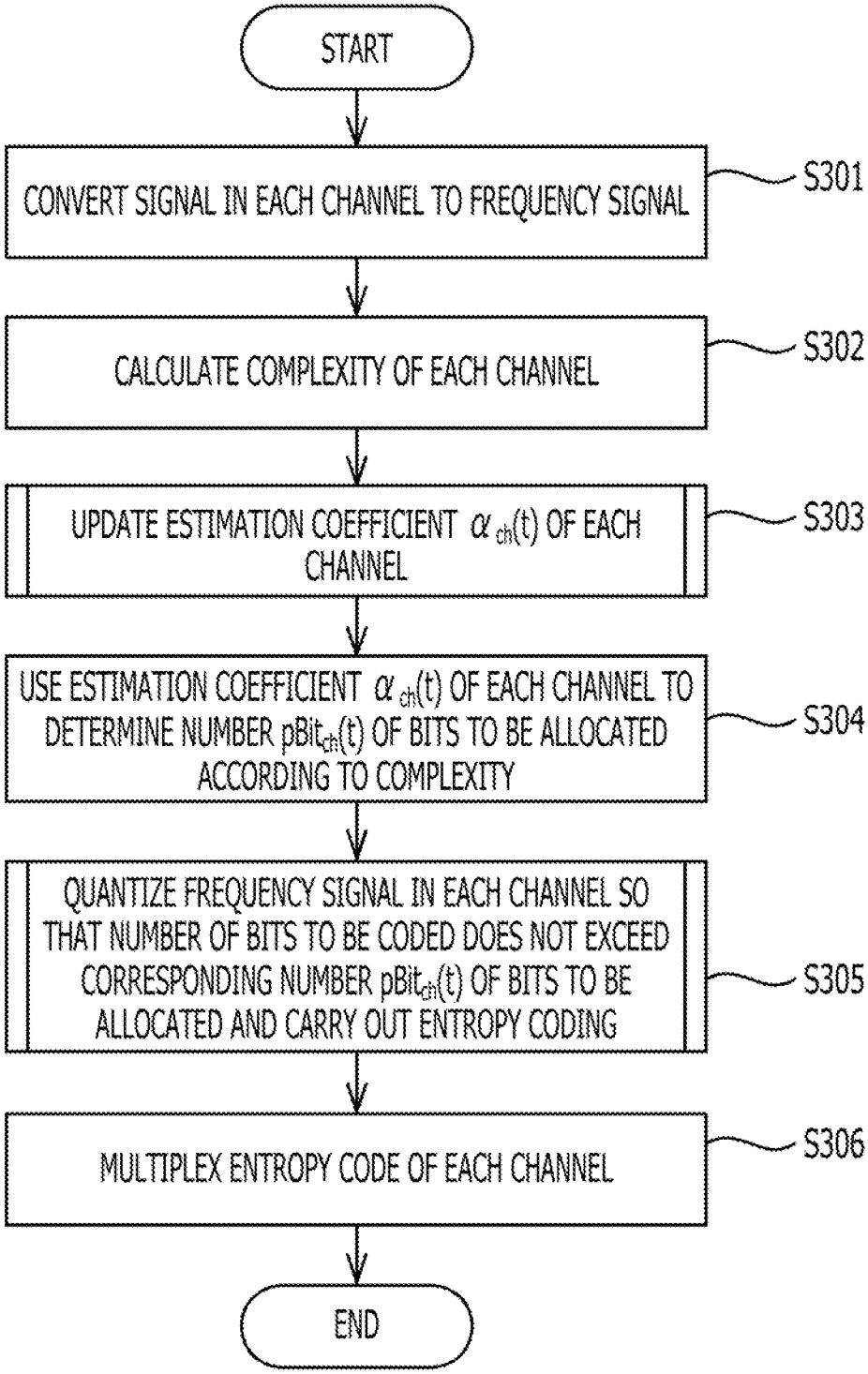
FIG. 6 is a flowchart illustrating the operation of an audio coding process.

FIG. 6 is a flowchart illustrating the operation of an audio coding process. The flowchart in FIG. 6 illustrates a process performed for an audio signal for one frame. The audio coding device 1 repeatedly executes the procedure for the audio coding process illustrated in FIG. 6 for each frame while the audio coding device 1 continues to receive audio signals.

The time-to-frequency converter 11 converts the signal in each channel to a frequency signal (operation S301). The time-to-frequency converter 11 then outputs the frequency signal in the channel to the complexity calculator 12 and coder 14. The complexity calculator 12 calculates the complexity for each channel (operation S302). As described above, in this embodiment, the complexity calculator 12 calculates the PE value of each channel and outputs the PE value calculated for the channel to the bit allocation controller 13.

The bit allocation controller 13 updates the estimation coefficient $\alpha_{ch}(t)$, which stipulates a relational equation between the complexity and the number of bits to be allocated, for each channel according to the number $rBit_{ch}(t-1)$ of non-adjusted coded bits for an already coded frame and to the number $pBit_{ch}(t-1)$ of bits to be allocated (operation S303). The bit allocation controller 13 uses the estimation coefficient $\alpha_{ch}(t)$ for each channel to determine the number $pBit_{ch}(t)$ of bits to be allocated so that the number $pBit_{ch}(t)$ of bits to be allocated is increased as the complexity is increased (operation S304). The bit allocation controller 13 then notifies the coder 14 of the number $pBit_{ch}(t)$ of bits to be allocated to the channel.

The coder 14 quantizes the frequency signal for each channel so that the number of bits to be coded does not exceed the number of bits to be allocated and entropy-codes the quantized frequency signal and the quantizer scale used for the quantization (operation S305). The coder 14 then outputs the entropy code to the multiplexer 15. The multiplexer 15 arranges the entropy code in each channel in the predetermined order to multiplex the entropy code (operation S306). The multiplexer 15 then outputs the coded audio signal resulting from the multiplexing. The audio coding device 1 completes the coding process.

Table 1 illustrates the results of an evaluation of the quality of a reproduced sound in a case in which bit allocation to each channel was carried out according to this embodiment when a four-sound-source 5.1-channel audio signal is coded at a bit rate of 160 kbps according to the MPEG surround method (ISO/IEC 23003-1) and a case in which bit allocation was not carried out.

TABLE 1

Comparison of Reproduced Sound Quality

| | ODG (averaged for channels) |
|---|---|
| The number of bits to be allocated was adjusted. | −2.54 |
| The number of bits to be allocated was not adjusted. | −2.40 |
| Degree of improvement | +0.14 |

Table 1 indicates an objective difference grade (ODG) averaged for channels when bits were not allocated for adjustment according to this embodiment, the ODG when bits were allocated, and the degree of improvement in the ODG in this embodiment sequentially from the top line in that order. The ODG is calculated by the perceived evaluation of audio quality (PEAQ) method, which is an objective evaluation technology standardized in ITU-R Recommendation BS.1387-1. The closer to 0 the ODG is, the higher the sound quality is. As indicated in Table 1, when the number of bits to be allocated was adjusted according to this embodiment, the ODG was improved by 0.14 point. This improvement degree is equivalent to a case in which the bit rate is increased by 10 kbps.

As described above, for an already coded frame, the audio coding device in the first embodiment obtains estimation error in the amount of bits to be allocated with respect to the number of non-adjusted coded bits as an index used in the update of the estimation coefficient. Accordingly, the audio coding device can accurately estimate the number of bits to be coded, so it can appropriately allocate bits to be coded to each channel. The audio coding device thus can suppress the deterioration of the sound quality of reproduced audio signals. The audio coding device can also reduce the amount of calculation required to update the estimation coefficient because the audio coding device does not decode coded frames.

Next, an audio coding device in a second embodiment will be described. A bit allocation controller in the second embodiment calculates an estimation error according to a difference or ratio between the initial value of the quantizer scale, determined by the coder, in the frame immediately following the frame to be coded and the quantizer scale at the time of the completion of coding. The audio coding device in the second embodiment has substantially the same structure as the audio coding device, in FIG. 1, in the first embodiment described above. The audio coding device in the second embodiment has substantially the same structure as the audio coding device in the first embodiment, except for the processes executed by the bit allocation controller 13 and coder 14.

Figure 7:
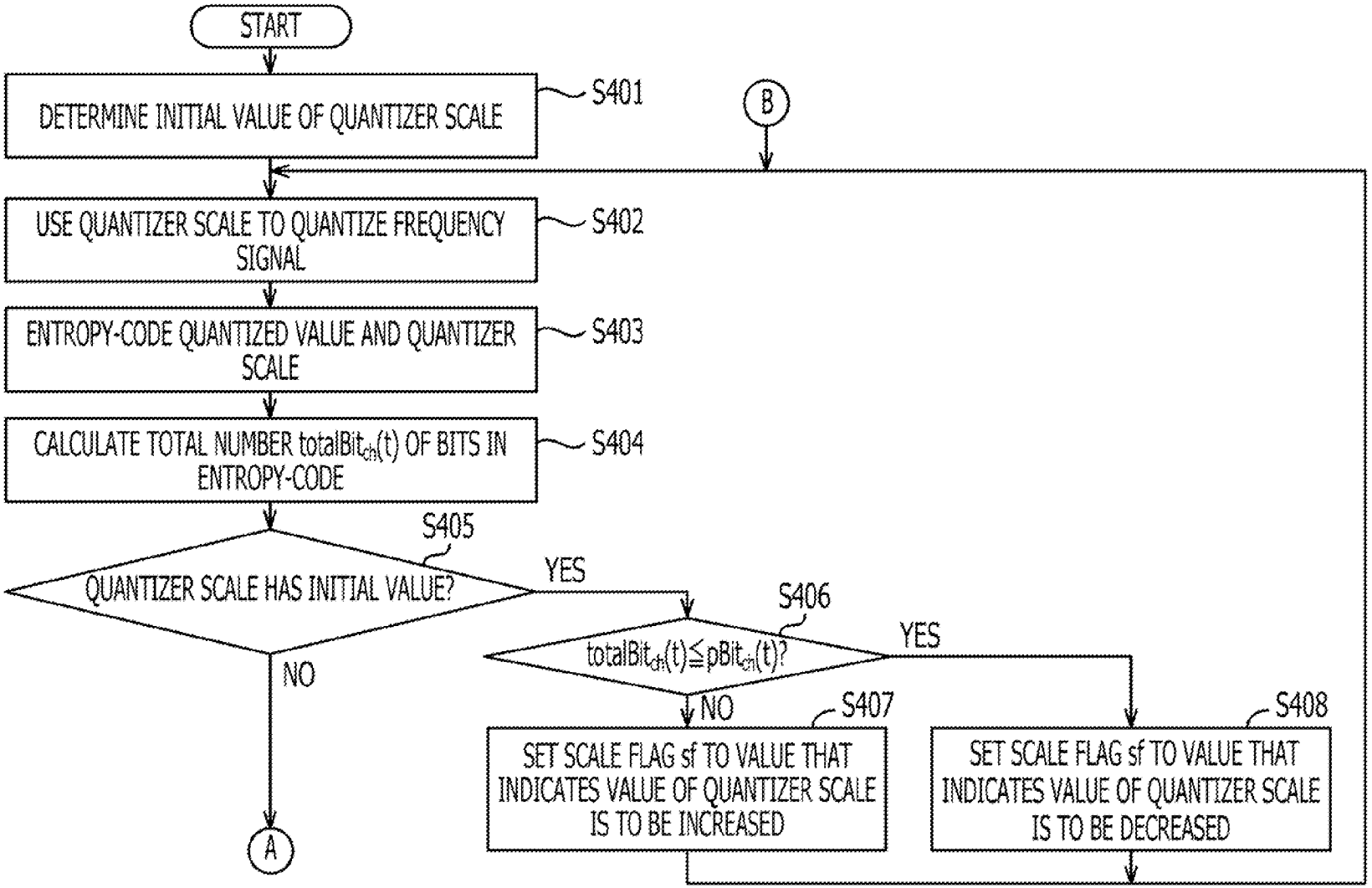
FIG. 7 is a flowchart illustrating the operation of a frequency signal coding process in a second embodiment.
Figure 8:
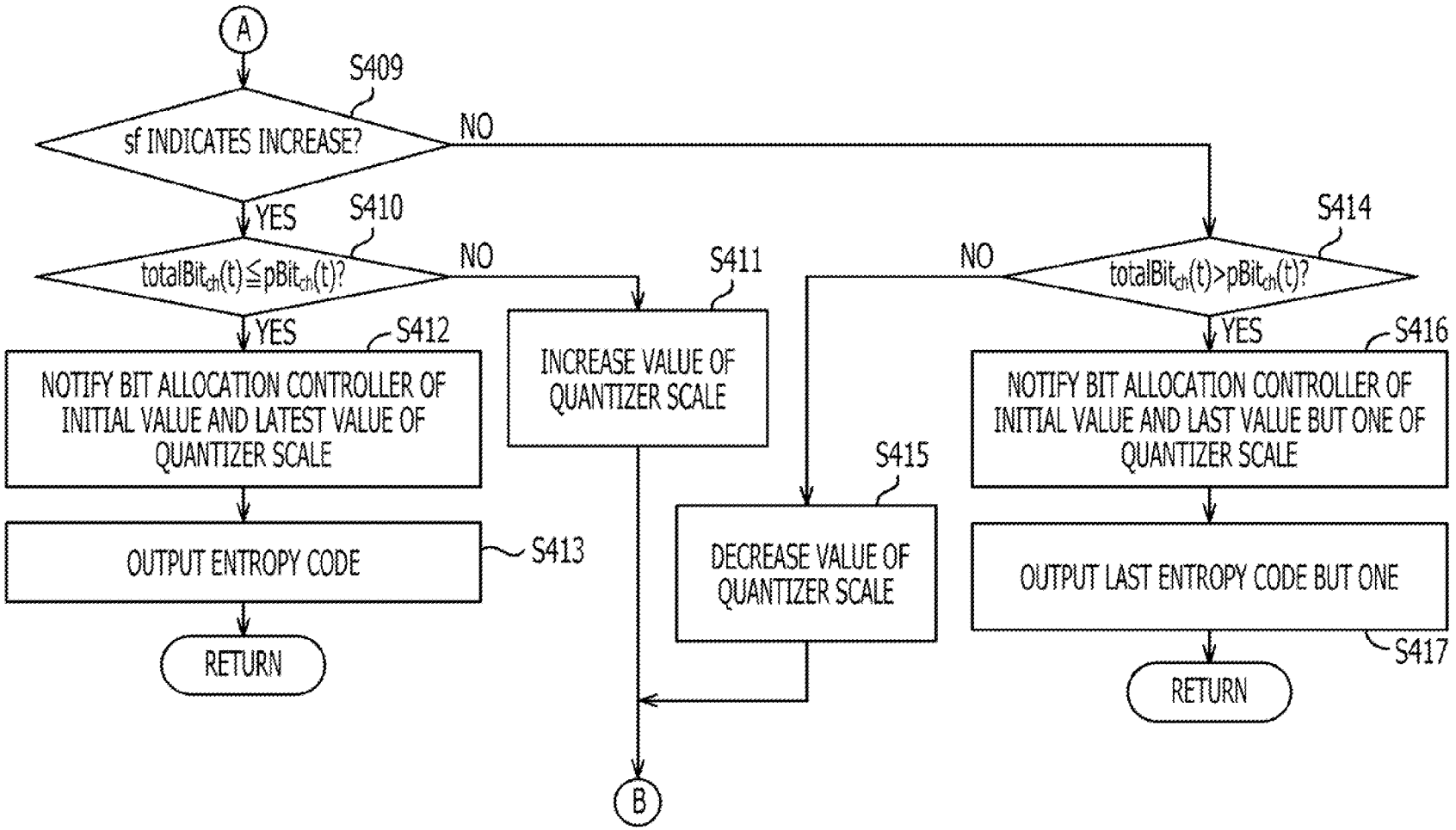
FIG. 8 is also a flowchart illustrating the operation of a frequency signal coding process in the second embodiment.

FIGS. 7 and 8 are flowcharts illustrating the operation of the coder 14 in the audio coding device in the second embodiment. The coder 14 codes the frequency signal in each channel for each frame according to these operation flowcharts. The coder 14 first determines the initial value of the quantizer scale, which stipulates a quantization width to quantize each frequency signal (operation S401). For example, the coder 14 determines the initial value of the quantizer scale according to equations (10) as in the first embodiment described above. The coder 14 then uses the quantizer scale, the initial value of which has been determined, to quantize the frequency signal according to, for example, equation (11) (operation S402). The coder 14 entropy-codes the quantized value and quantizer scale of the frequency signal in each channel (operation S403). The coder 14 then calculates the total number $totalBit_{ch}(t)$ of bits in the entropy-coded quantized value and quantizer scale (operation S404) for each channel. The coder 14 determines whether the quantizer scale, which has been used for quantization, has its initial value (operation S405). If the value of the quantizer scale is its initial value (the result in operation S405 is Yes), the coder 14 determines whether the total number $totalBit_{ch}(t)$ of bits in the entropy code is equal to or less than the number $pBit_{ch}(t)$ of bits to be allocated (operation S406). If $totalBit_{ch}(t)$ is greater than the number $pBit_{ch}(t)$ of bits to be allocated (the result in operation S406 is No), the coder 14 increases the value of the quantizer scale to reduce the number of bits to be coded (operation S407). For example, the coder 14 doubles the value of the quantizer scale provided for each frequency band. Alternatively, the coder 14 sets a scale flag sf, which indicates whether the quantizer scale is adjusted to increase or decrease its value, to a value indicating that the value of the quantizer scale is to be increased. The coder 14 then stores the initial value of the quantizer scale and the value of the scale flag sf in the memory disposed in the coder 14.

If the total number $totalBit_{ch}(t)$ of bits in the entropy code is less than the number $pBit_{ch}(t)$ of bits to be allocated (the result in operation S406 is Yes), the coder 14 reduces the value of the quantizer scale to check whether the number of bits to be coded can be increased (operation S408). For example, the coder 14 halves the value of the quantizer scale provided for each frequency band. Alternatively, the coder 14 sets the scale flag sf to a value indicating that the value of the quantizer scale is to be decreased. The coder 14 then stores the initial value of the quantizer scale and the value of the scale flag sf in the memory disposed in the coder 14. After executing operation S407 or S408, the coder 14 reexecutes the processes in operation S402 and later.

If the value of the quantizer scale is not the initial value in operation S405 (the result in operation S405 is No), the coder 14 determines whether the value of the scale flag sf, stored in the memory, indicates that the value of the quantizer scale is to be increased (operation S409), as illustrated in FIG. 8. If the value of the scale flag sf indicates that the value of the quantizer scale is to be increased (the result in operation S409 is Yes), the coder 14 determines whether the total number $totalBit_{ch}(t)$ of bits in the entropy code is equal to or less than the number $pBit_{ch}(t)$ of bits to be allocated (operation S410). If $totalBit_{ch}(t)$ is greater than $pBit_{ch}(t)$ (the result in operation S410 is No), the coder 14 increases the value of the quantizer scale (operation S411). The coder 14 then reexecutes the processes in operation S402 and later.

If $totalBit_{ch}(t)$ is equal to or less than $pBit_{ch}(t)$ (the result in operation S410 is Yes), the coder 14 notifies the bit allocation controller 13 of the initial value and the latest value of the quantizer scale (operation S412). The coder 14 also outputs the entropy code of the frequency signal quantized by using the initial value and the latest value of the quantizer scale to the multiplexer 15 as coded data of the channel (operation S413). The coder 14 then terminates the process to code the frequency signal for the channel.

If the value of the scale flag sf indicates that the value of the quantizer scale is to be decreased in operation S409 (the result in operation S409 is No), the coder 14 determines whether $totalBit_{ch}(t)$ is greater than $pBit_{ch}(t)$ (operation S414). If $totalBit_{ch}(t)$ is equal to or less than $pBit_{ch}(t)$(the result in operation S414 is No), the coder 14 decreases the value of the quantizer scale (operation S415). The coder 14 also stores, in the memory, the quantizer scale value and entropy code before they were corrected. The coder 14 then reexecutes the processes in operation S402 and later.

If $totalBit_{ch}(t)$ is greater than $pBit_{ch}(t)$ (the result in operation S414 is Yes), the coder 14 notifies the bit allocation controller 13 of the initial value and last value but one of the quantizer scale (operation S416). The coder 14 also outputs the last value but one of the quantizer scale and the entropy code of the frequency signal quantized with that quantizer scale to the multiplexer 15 as the coded data of the channel (operation S417). The coder 14 then terminates the process to code the frequency signal for the channel.

Figure 9:
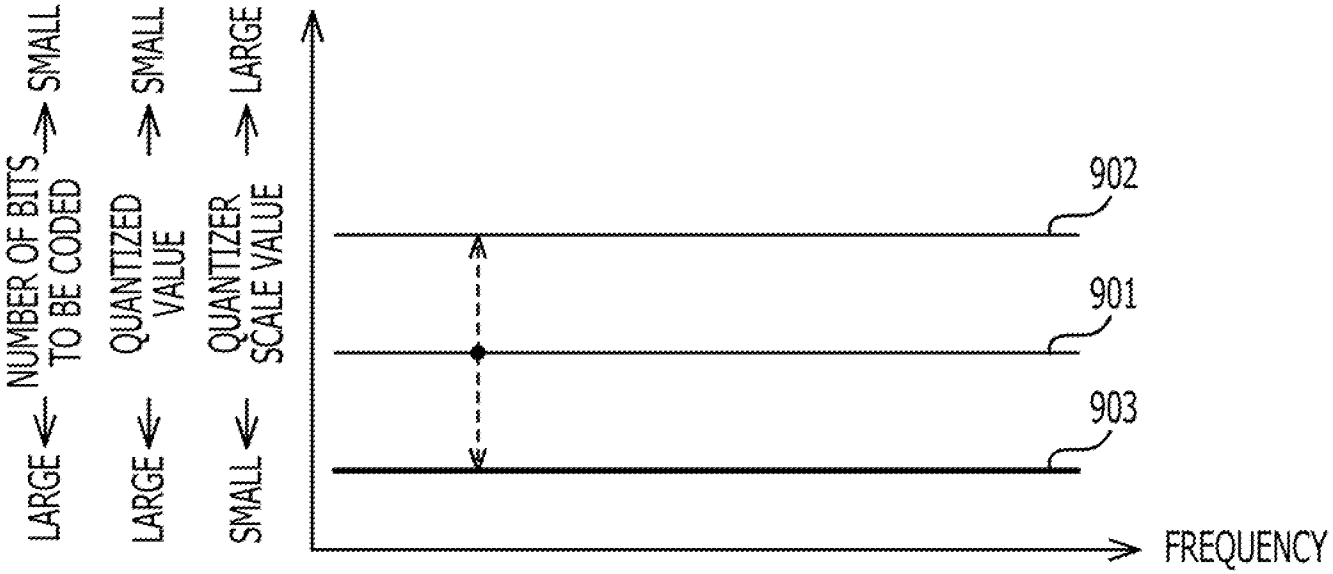
FIG. 9 conceptually illustrates quantizer scales upon completion of coding and a quantizer scale having an initial value and also illustrates a relation among the quantizer scales, the quantization signal value of a frequency signal, a quantization signal of an entropy-coded quantization signal, and the number of bits to be coded for the quantizer scale.

FIG. 9 conceptually illustrates quantizer scales upon completion of coding and a quantizer scale having an initial value and also illustrates a relation among the quantizer scales, the quantization signal value of a frequency signal, a quantization signal of an entropy-coded quantization signal, and the number of bits to be coded for the quantizer scale. A line 901 is a graph representing the initial value of the quantizer scale in each frequency band. Lines 902 and 903 are each a graph representing the value of the quantizer scale in each frequency band upon completion of coding. The horizontal axis indicates frequencies and the vertical axis indicates quantizer scale values.

If the number of non-adjusted coded bits is greater than the number of bits to be allocated, the quantizer scale value upon completion of coding is adjusted so that it is greater than the initial value of the quantizer scale as indicated by the line 902. Accordingly, as the value of the quantizer scale upon completion of coding is increased, the quantized value of each frequency signal upon completion of coding and the number of coded bits are decreased.

Conversely, if the number of non-adjusted coded bits is less than the number of bits to be allocated, the quantizer scale value upon completion of coding is adjusted so that it is less than the initial value of the quantizer scale as indicated by the line 903. Accordingly, as the value of the quantizer scale upon completion of coding is decreased, the quantized value of each frequency signal upon completion of coding and the number of coded bits are increased. Thus, the bit allocation controller 13 can optimize the number of bits to be allocated to each channel by updating the estimation coefficient so that as the quantizer scale value upon completion of coding is greater than the initial value of the quantizer scale, more bits are allocated.

The estimation error calculating part 132 in the bit allocation controller 13 calculates, for each channel, the difference ($IScale_{ch}(t-1)-fScale_{ch}(t-1)$) between the value $IScale_{ch}(t-1)$ of the quantizer scale upon completion of coding and the initial value $fScale_{ch}(t-1)$ of the quantizer scale in the last frame but one as the amount $dScale_{ch}(t)$ of scale adjustment. If the quantizer scale is calculated for each frequency band as in a case in which equations (10) are used, the estimation error calculating part 132 assumes the average of the initial values of the quantizer scales in all frequency bands to be $fScale_{ch}(t-1)$. Similarly, the estimation error calculating part 132 assumes the average of the values of the quantizer scales upon completion of coding in all frequency bands to be $IScale_{ch}(t-1)$. Alternatively, the estimation error calculating part 132 may calculate a ratio ($IScale_{ch}(t-1)/fScale_{ch}(t-1)$) of the initial value of the quantizer scale to the value of the quantizer scale upon completion of coding as the amount $dScale_{ch}(t)$ of scale adjustment.

The estimation error calculating part 132 determines the estimation error $diff_{ch}(t)$ with respect to the amount $dScale_{ch}(t)$ of scale adjustment according to a relational equation between the amount $dScale_{ch}(t)$ of scale adjustment and the estimation error $diff_{ch}(t)$. The relational equation is, for example, experimentally determined in advance. For example, the relational equation is determined so that as the amount $dScale_{ch}(t)$ of scale adjustment becomes greater, the estimation error $diff_{ch}(t)$ also becomes greater. The relational equation is prestored in a memory provided in the estimation error calculating part 132. Alternatively, a reference table representing the relation between the amount $dScale_{ch}(t)$ of scale adjustment and the estimation error $diff_{ch}(t)$ may be prestored in the memory disposed in the estimation error calculating part 132. In this case, the estimation error calculating part 132 determines the estimation error $diff_{ch}(t)$ with respect to the amount $dScale_{ch}(t)$ of scale adjustment by referencing the reference table.

The estimation error calculating part 132 notifies the coefficient updating part 133 of the estimation error $diff_{ch}(t)$. The coefficient updating part 133 updates the estimation coefficient by performing a process as in the first embodiment. In the second embodiment, the bit allocation controller 13 is not notified of the number $rBit_{ch}(t-1)$ of non-adjusted coded bits. Therefore, the coefficient updating part 133 calculates the gradient correction coefficient $CorFac_{ch}(t)$ according to the following equation instead of equation (8).

$$CorFac_{ch}(t) = \frac{pBit_{ch}(t-1) + diff_{ch}(t)}{pBit_{ch}(t-1)} \tag{12}$$

Since the amount of quantizer scale adjustment is an index that represents estimation error in the number of bits to be coded, the audio coding device in the second embodiment can also optimize the number of bits to be allocated to each channel.

Next, an audio coding device in a third embodiment will be described. The audio coding device in the third embodiment adjusts the number of bits to be allocated to each channel so that, for example, that number does not exceed an upper limit of the number of available bits to be coded, which is determined according to a transfer rate or the like. The audio coding device in the third embodiment differs from the audio coding devices in the first and second embodiments only in the process executed by the bit count determining part of the bit allocation controller. Therefore, the description that follows focuses only on the bit count determining part.

The bit count determining part calculates the total number totalAllocatedBit(t) of bits to be allocated to each bit for each frame. The estimation coefficient used to determine the number of bits to be allocated to each channel may be updated according to any of the first and second embodiments. If totalAllocatedBit(t) is greater than an upper limit allowedBits (t) of the number of bits to be coded in the frame t, the bit count determining part corrects the number of bits to be allocated according to the following equation so that the total number of bits to be allocated to all channels does not exceed allowedBits(t).

$$pBit_{ch}'(t)=\beta_{ch}\cdot allowdBits(t) \tag{13}$$

where $pBit_{ch}'(t)$ is the corrected number of bits to be allocated to the channel ch, and $\beta_{ch}$ is a coefficient used to determine the number of bits to be allocated to the channel ch. For example, the coefficient $\beta_{ch}$ is set to the reciprocal of the number N of channels included in an audio signal to be coded so that the same number of bits is allocated to each channel. Alternatively, the coefficient $\beta_{ch}$ may be set to a channel-specific ratio. In this case, the coefficient $\beta_{ch}$ is set so that the total of the settings of the coefficient $\beta_{ch}$ becomes 1. Alternatively, the coefficient $\beta_{ch}$ may be set so that a channel that more largely affects the quality of a reproduced sound has a greater value.

Alternatively, the coefficient $\beta_{ch}$ may be set according to the following equation so as to maintain a channel-specific relative ratio of the number of bits to be allocated before that number is corrected.

$$\beta_{ch}(t) = \frac{pBit_{ch}(t)}{\sum_{ch=1}^{N} pBit_{ch}(t)},\ ch = 1, \ldots N \tag{14}$$

where $pBit_{ch}(t)$ is the number of bits to be allocated to the channel ch before that number is corrected, and N is the number of channels included in the audio signal to be coded. The bit count determining part may use the PE value of each channel instead of $pBit_{ch}(t)$ in equation (14).

As described above, the audio coding device in the third embodiment can optimize the number of bits to be allocated to each channel to suit an upper limit of the number of available bits.

Next, an audio coding device in a fourth embodiment will be described. The audio coding device in the fourth embodiment determines estimation error with acoustic deterioration taken into consideration. The audio coding device in the fourth embodiment differs from the audio coding devices in the first to third embodiments only in the process executed by the estimation error calculating part of the bit allocation controller. Therefore, the description that follows focuses only on the estimation error calculating part.

Figure 10:
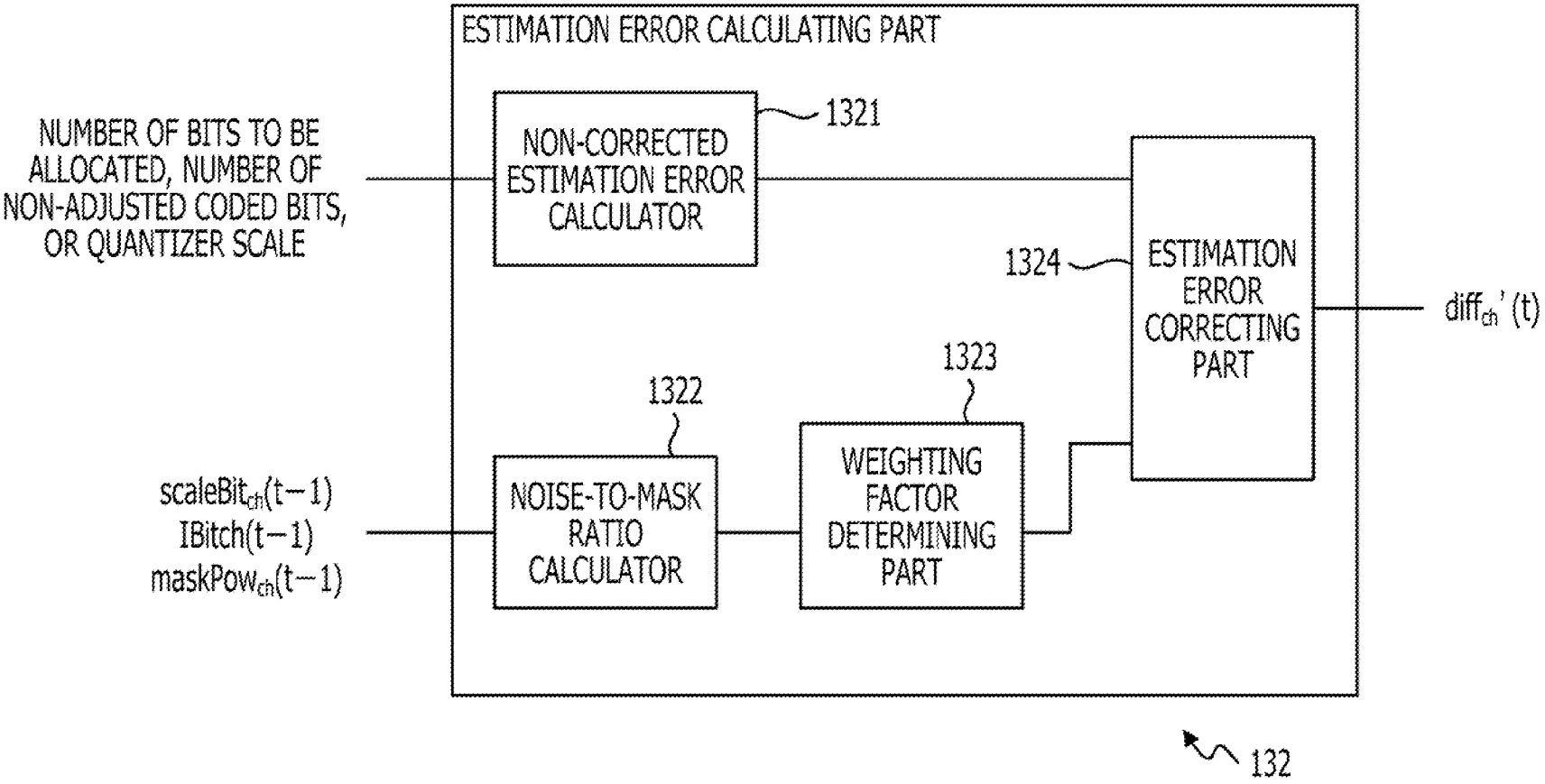
FIG. 10 schematically shows the structure of an estimation error calculating part in an audio coding device in a fourth embodiment.

FIG. 10 schematically shows the structure of the estimation error calculating part in the audio coding device in the fourth embodiment. The estimation error calculating part 132 has a non-corrected estimation error calculator 1321, a noise-to-mask ratio calculator 1322, a weighting factor determining part 1323, and an estimation error correcting part 1324.

The non-corrected estimation error calculator 1321 calculates the estimation error $diff_{ch}(t)$ for each channel by executing a process similar to the process executed by the estimation error calculating part in the first or second embodiment. The non-corrected estimation error calculator 1321 outputs the estimation error $diff_{ch}(t)$ in each channel to the estimation error correcting part 1324.

The noise-to-mask ratio calculator 1322 calculates a quantization error in each channel in the frame (t−1) immediately following the frame to be coded. The noise-to-mask ratio calculator 1322 then calculates a ratio $NMR_{ch}(t-1)$ between the quantization error and the masking threshold for each channel. In this case, the noise-to-mask ratio calculator 1322 can receive the channel-specific masking threshold from the complexity calculator 12 and can use the received masking threshold. It is known that as the ratio of the number $scaleBit_{ch}(t-1)$ of bits to be coded for the quantizer scale to the number $IBit_{ch}(t-1)$ of bits to be coded is greater, the quantization error is more monotonously increased, the ratio being taken upon completion of coding. Therefore, a correspondence relation between the ratio $scaleBit_{ch}(t-1)/IBit_{ch}(t-1)$ and the quantization error $Err_{ch}(t-1)$ is, for example, experimentally determined in advance. A reference table representing the correspondence relation between the ratio $scaleBit_{ch}(t-1)/IBit_{ch}(t-1)$ and the quantization error $Err_{ch}(t-1)$ is prestored in a memory provided in the noise-to-mask ratio calculator 1322. Alternatively, the noise-to-mask ratio calculator 1322 may determine the quantization error $Err_{ch}(t-1)$ corresponding to the ratio $scaleBit_{ch}(t-1)/IBit_{ch}(t-1)$, according to a relational equation that represents a relation between the ratio $scaleBit_{ch}(t-1)/IBit_{ch}(t-1)$ and the quantization error $Err_{ch}(t-1)$. In this case, the relational equation is, for example, experimentally obtained in advance and prestored in the memory disposed in the noise-to-mask ratio calculator 1322. The noise-to-mask ratio calculator 1322 receives, from the coder 14, the number $scaleBit_{ch}(t-1)$ of bits to be coded for the quantizer scale, in correspondence to the number $IBit_{ch}(t-1)$ of bits to be coded and calculates their ratio $scaleBit_{ch}(t-1)/IBit_{ch}(t-1)$. The noise-to-mask ratio calculator 1322 determines the quantization error $Err_{ch}(t-1)$ corresponding to the ratio $scaleBit_{ch}(t-1)/IBit_{ch}(t-1)$ by referencing the reference table or relational equation.

When the quantization error $Err_{ch}(t-1)$ is determined, the noise-to-mask ratio calculator 1322 calculates $NMR_{ch}(t-1)$ according to the following equation.

$$NMR_{ch}(t) = 10\log_{10}\left(\frac{Err_{ch}(t-1)}{maskPow_{ch}(t-1)}\right) \tag{15}$$

where $maskPow_{ch}(t-1)$ is the total of the masking thresholds in all frequency bands in the channel ch in the frame (t−1). The noise-to-mask ratio calculator 1322 notifies the weighting factor determining part 1323 of channel-specific $NMR_{ch}(t-1)$ The weighting factor determining part 1323 determines a weighting factor $W_{ch}$, by which the estimation error is multiplied, for each channel according to $NMR_{ch}(t-1)$. If the value of $NMR_{ch}(t-1)$ is positive, that is, the quantization error is greater than the total of the masking thresholds in all frequency bands, the quantization error is so large that a listener can perceive the quantization error as reproduced sound deterioration. If the value of $NMR_{ch}(t-1)$ is positive, therefore, the weighting factor determining part 1323 sets the weighting factor $W_{ch}$ to a greater value as the $NMR_{ch}(t-1)$ becomes greater so that the number of bits to be allocated is increased to reduce the quantization error.

If the value of $NMR_{ch}(t-1)$ is negative, that is, the quantization error is less than the total of the masking thresholds in all frequency bands, the listener cannot perceive the quantization error as reproduced sound deterioration. Therefore, the number of bits allocated to the channel is assumed to be excessive. If the value of $NMR_{ch}(t-1)$ is negative, therefore, the weighting factor determining part 1323 sets the weighting factor $W_{ch}$ to a smaller value as the $NMR_{ch}(t-1)$ becomes smaller so that the number of bits to be allocated is decreased. When the value of $NMR_{ch}(t-1)$ is negative, the weighting factor determining part 1323 may set the weighting factor $W_{ch}$ to 0.

To determine the weighting factor $W_{ch}$, a reference table that represents the relation between $NMR_{ch}(t-1)$ and the weighting factor $W_{ch}$ may be prestored in the memory disposed in the weighting factor determining part 1323. The weighting factor determining part 1323 determines the weighting factor $W_{ch}$ corresponding to $NMR_{ch}(t-1)$ by referencing the reference table. Alternatively, the weighting factor determining part 1323 may determine the weighting factor $W_{ch}$ corresponding to $NMR_{ch}(t-1)$ according to a relational equation that represents a relation between $NMR_{ch}(t-1)$ and the weighting factor $W_{ch}$. In this case, the relational equation is, for example, experimentally obtained in advance and prestored in the memory disposed in the weighting factor determining part 1323; an example of the obtained relational equation is a quadratic function that is downwardly convexed and has the minimum value when $NMR_{ch}(t-1)$ is 0. The weighting factor determining part 1323 outputs the weighting factor of each channel to the estimation error correcting part 1324.

The estimation error correcting part 1324 multiplies the estimation error $diff_{ch}(t)$ calculated by the non-corrected estimation error calculator 1321 by the weighting factor $W_{ch}$ to obtain a corrected estimation error $diff_{ch}'(t)$ for each channel, and outputs the corrected estimation error $diff_{ch}'(t)$ to the coefficient updating part 133. The coefficient updating part 133 updates the estimation coefficient according to the corrected estimation error $diff_{ch}'(t)$. Then, the bit count determining part 131 determines the number of bits to be allocated according to the corrected estimation error $diff_{ch}'(t)$. Alternatively, the bit count determining part 131 may correct the number of bits to be allocated to each channel so that the total number of bits to be allocated to all channels does not exceed an upper limit of the number of available bits, as in the third embodiment.

Since the audio coding device in the fourth embodiment determines the number of bits to be allocated to each channel in consideration of acoustic deterioration caused by quantization error as described above, the audio coding device can optimize the number of bits to be allocated to each channel.

When an audio signal has a plurality of channels, the coder in each of the above embodiments may code a signal obtained by downmixing the frequency signals in the plurality of channels. In this case, the audio coding device further has a downmixing part that downmixes the frequency signals in the plurality of channels, which are obtained by the time-to-frequency converter, and obtains spatial information about similarity among the frequency signals in the channels and difference in strength among them. The complexity calculator and bit allocation controller may obtain complexity and the number of bits to be allocated for each frequency signal downmixed by the downmixing part. The coder also codes the spatial information by using, for example, the method described in ISO/IEC 23003-1:2007.

The coefficient updating part in the bit allocation controller may use a several previous frame, instead of the last frame but one, as the frame used as a reference to update the estimation coefficient for frames to be coded. In this case, to calculate the gradient correction coefficient, the coefficient updating part can use, for example, the number of bits to be allocated, the number of non-adjusted coded bits, and estimation error in the several previous frame in equation (8) or (12).

A computer program that causes a computer to execute the functions of the parts in the audio coding device in each of the above embodiments may be provided by being stored in a semiconductor memory, a magnetic recording medium, an optical recording medium, or another type of recording medium. However, the computer-readable medium does not include a transitory medium such as a propagation signal.

The audio coding device in each of the above embodiments is mounted in a computer, a video signal recording apparatus, an image transmitting apparatus, or any of other various types of apparatuses that are used to transmit or record audio signals.

Figure 11:
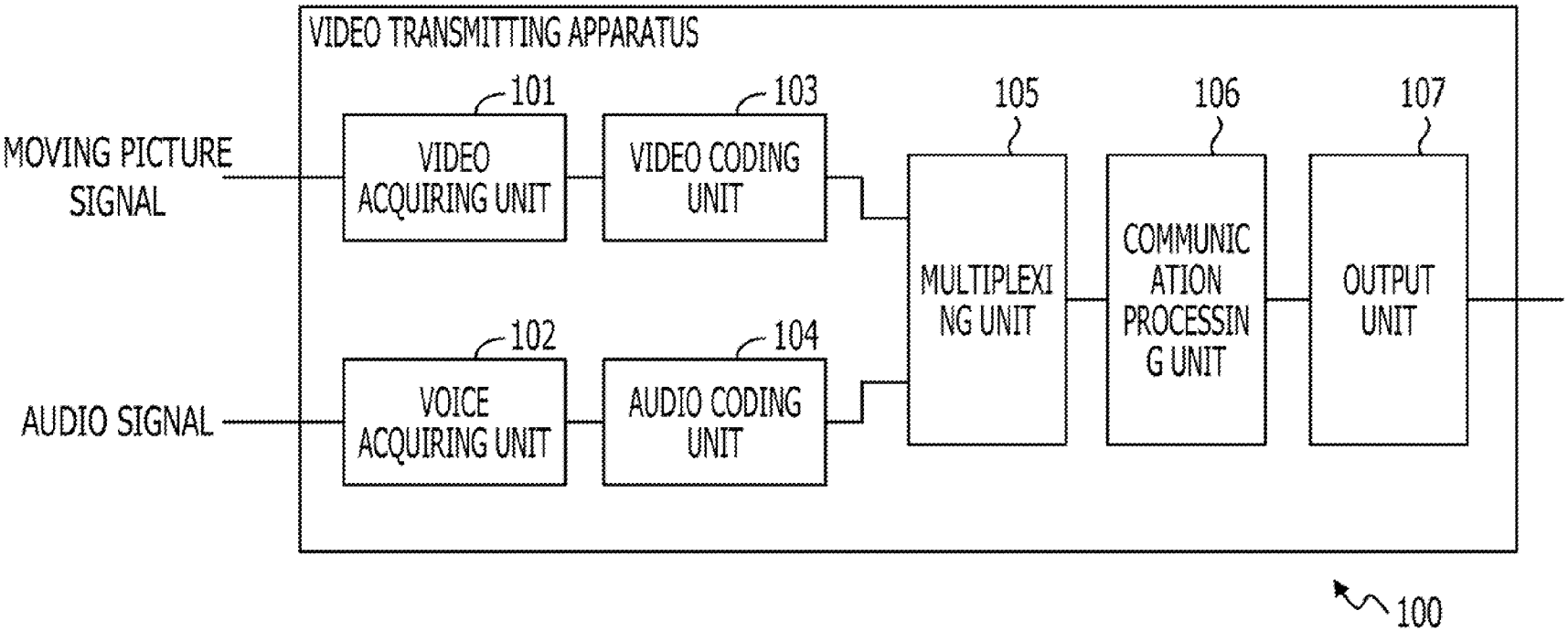
FIG. 11 schematically shows the structure of a video transmitting apparatus in which the audio coding device in any one of the first to fourth embodiments is included.

FIG. 11 schematically shows the structure of a video transmitting apparatus in which the audio coding device in any of the above embodiments is included. The video transmitting apparatus 100 includes a video acquiring unit 101, a voice acquiring unit 102, a video coding unit 103, an audio coding unit 104, a multiplexing unit 105, a communication processing unit 106, and an output unit 107.

The video acquiring unit 101 has an interface circuit through which a moving picture signal is acquired from a video camera or another unit. The video acquiring unit 101 transfers the moving picture signal received by the video transmitting apparatus 100 to the video coding unit 103.

The voice acquiring unit 102 has an interface circuit through which an audio signal is acquired from a microphone or another unit. The voice acquiring unit 102 transfers the audio signal received by the video transmitting apparatus 100 to the audio coding unit 104.

The video coding unit 103 codes the moving picture signal to reduce the amount of data included in the moving picture signal according to, for example, a moving picture coding standard such as MPEG-2, MPEG-4, or H.264 MPEG-4 Advanced Video Coding (H.264 MPEG-4 AVC). The video coding unit 103 then outputs the coded moving picture data to the multiplexing unit 105.

The audio coding unit 104, which has the audio coding device in any of the above embodiments, codes the audio signal according to any of the above embodiments and outputs the resulting coded audio data to the multiplexing unit 105.

The multiplexing unit 105 mutually multiplexes the coded moving picture data and coded audio data. The multiplexing unit 105 also creates a stream conforming to a prescribed form used for video data transmission, such as an MPEG-2 transport stream.

The multiplexing unit 105 then outputs the stream, in which the coded moving picture data and coded audio data have been mutually multiplexed, to the communication processing unit 106.

The communication processing unit 106 divides the stream, in which the coded moving picture data and coded audio data have been mutually multiplexed, into packets conforming to a prescribed communication standard such as TCP/IP. The communication processing unit 106 also adds a prescribed header having destination information and other information to each packet, and transfers the packets to the output unit 107.

The output unit 107 has an interface through which the video transmitting apparatus 100 is connected to a communication line. The output unit 107 outputs the packets received from the communication processing unit 106 to the communication line.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio coding device comprising:

a time-to-frequency converter that performs time-to-frequency conversion on each frame of a signal in at least one channel included in an audio signal in a predetermined length of time in order to convert the signal in the at least one channel to a frequency signal;

a complexity calculator that calculates a first value indicating complexity of the frequency signal for each of the at least one channel, based on a spectral power of a frequency bandwidth and a masking threshold representing a power of a lower limit frequency signal of a sound that a listener is able to hear;

a bit allocation controller that:

determines a second value indicating a number of bits to be allocated to each frame of audio signals for each of the at least one channel so that the second value increases as the first value increases, calculates a third value indicating a number of bits that have been required to code each frame of the frequency signal so that reproduced sound quality of a previous frame meets a prescribed criterion, and updates the second value so that the second value increases as an estimation error indicating an estimated number of error bits that have occurred in the previous frame; and a coder that codes the frequency signal in each channel so that a number of available bits for each frame of coded audio signals does not exceeds the updated second value.

2. The audio coding device according to claim 1, wherein, for the previous frame, the coder quantizes the frequency signal with a first quantizer scale by which reproduced sound quality meets the criterion, calculates a number of bits to be coded that is obtained by coding the quantized frequency signal and the first quantizer scale according to a prescribed coding method, as third value, and determines a second quantizer scale so that a number of bits to be coded does not exceed the second value, the number of bits to be coded being obtained by quantizing the frequency signal with the second quantizer scale and by coding the second quantizer scale and the quantized frequency signal according to a prescribed coding method, and wherein, for the previous frame, the bit allocation controller calculates, as the estimation error, a difference between third value and second value or a ratio of the third value to second value.

3. The audio coding device according to claim 2, wherein, for the previous frame, the coder determines a first quantizer scale by which reproduced sound quality meets the criterion and also determines a second quantizer scale so that a number of bits to be coded does not exceed the number of bits to be allocated, the number of bits to be coded being obtained by quantizing the frequency signal with the second quantizer scale and by coding the second quantizer scale and the quantized frequency signal according to a prescribed coding method, and wherein the bit allocation controller takes a greater value for the estimation error as the second quantizer scale is greater than the first quantizer scale.

4. The audio coding device according to claim 2, wherein the bit allocation controller corrects the estimation error so that the estimation error takes a greater value as a quantization error is greater than an upper limit of power of the frequency signal for which a listener is not able to perceive deterioration of reproduced sound quality, the quantization error being caused when the coder quantizes the frequency signal with the second quantizer scale in the previous frame.

5. The audio coding device according to claim 1, wherein the audio signal includes two or more channels, and wherein the bit allocation controller sets the second value so that a total of the number of bits to be individually allocated to the two or more channels does not exceed an upper limit of a number of available bits.

6. The audio coding device according to claim 1, wherein the first value indicating complexity is a perceptual entropy.

7. The audio coding device according to claim 1, wherein the bit allocation controller determines the second value according to a value obtained by multiplying the first value of each of the at least one channel by an estimation coefficient determined for each of the at least one channel, and updates the estimation coefficient when the estimation error is outside a prescribed allowable range over a prescribed number of frames, which is equal to or greater than 1.

8. An audio coding method comprising:

performing time-to-frequency conversion on each frame of a signal in at least one channel included in an audio signal in a predetermined length of time in order to convert the signal in the at least one channel to a frequency signal;

calculating a first value indicating complexity of the frequency signal for each of the at least one channel, based on a spectral power of a frequency bandwidth and a masking threshold representing a power of a lower limit frequency signal of a sound that a listener is able to hear;

determining a second value indicating a number of bits to be allocated to each frame of audio signals for each of the at least one channel so that the second value increases as the first value increases;

calculating a third value indicating a number of bits that have been required to code each frame of the frequency signal so that reproduced sound quality of a previous frame meets a prescribed criterion;

updating the second value so that the second value increases as an estimation error indicating an estimated number of error bits that have occurred in the previous frame increases; and coding the frequency signal in each channel so that a number of available bits for each frame of coded audio signals does not exceeds the updated second value.

9. The audio coding method according to claim 8, wherein, in coding the frequency signal, the frequency signal is quantized for the previous frame with a first quantizer scale by which reproduced sound quality meets the criterion, a number of bits to be coded that is obtained by coding the quantized frequency signal and the first quantizer scale according to a prescribed coding method is calculated as the third value, and a second quantizer scale is determined so that a number of bits to be coded does not exceed second value, the number of bits to be coded being obtained by quantizing the frequency signal with the second quantizer scale and by coding the second quantizer scale and the quantized frequency signal according to a prescribed coding method, and wherein, in increasing the number of bits to be allocated, a difference between the third value and the second value or a ratio of the third value to the second value is calculated for the previous frame as the estimation error.

10. The audio coding method according to claim 9, wherein, in coding the frequency signal, a first quantizer scale by which reproduced sound quality meets the criterion and a second quantizer scale are determined for the previous frame, the second quantizer scale being determined so that a number of bits to be coded does not exceed the number of bits to be allocated, the number of bits to be coded being obtained by quantizing the frequency signal with the second quantizer scale and by coding the second quantizer scale and the quantized frequency signal according to a prescribed coding method, and wherein, in increasing the number of bits to be allocated, the estimation error takes a greater value as the second quantizer scale is greater than the first quantizer scale.

11. The audio coding method according to claim 10, wherein, in increasing the number of bits to be allocated, the estimation error is corrected so that the estimation error takes a greater value as a quantization error is greater than an upper limit of power of the frequency signal for which a listener is not able to perceive deterioration of reproduced sound quality, the quantization error being caused when the frequency signal is quantized with the second quantizer scale in the coding the frequency signal in the previous frame.

12. The audio coding method according to claim 8, wherein the audio signal includes two or more channels, and wherein, in increasing the second value, the second value is set so that a total of the numbers of bits to be individually allocated to the two or more channels does not exceed an upper limit of a number of available bits.

13. The audio coding method according to claim 8, wherein, in increasing the second value, the second value is determined according to a value obtained by multiplying the first value of each of the at least one channel by an estimation coefficient determined for each of the at least one channel, and the estimation coefficient is updated when the estimation error is outside a prescribed allowable range over a prescribed number of frames, which is equal to or greater than 1.

14. A non-transitory, computer-readable recording medium storing an audio coding computer program that causes a computer to execute a process comprising:

performing time-to-frequency conversion on each frame of a signal in at least one channel included in an audio signal in a predetermined length of time in order to convert the signal in the at least one channel to a frequency signal;

calculating a first value indicating complexity of the frequency signal for each of the at least one channel, based on a spectral power of a frequency bandwidth and a masking threshold representing a power of a lower limit frequency signal of a sound that a listener is able to hear;

determining a second value indicating a number of bits to be allocated to each frame of audio signals for each of the at least one channel so that the second value increases as the first value increases;

calculating a third value indicating a number of bits that have been required to code each frame of the frequency signal so that reproduced sound quality of a previous frame meets a prescribed criterion;

updating the second value so that the second value increases as an estimation error indicating an estimated number of error bits that have occurred in the previous frame increases; and coding the frequency signal in each channel so that a number of available bits for each frame of coded audio signals does not exceeds the updated second value.

15. The non-transitory, computer-readable recording medium storing the audio coding computer program according to claim 14, wherein, in coding the frequency signal, the frequency signal is quantized for the previous frame with a first quantizer scale by which reproduced sound quality meets the criterion, a number of bits to be coded that is obtained by coding the quantized frequency signal and the first quantizer scale according to a prescribed coding method is calculated as third value, and a second quantizer scale is determined so that a number of bits to be coded does not exceed the second value, the number of bits to be coded being obtained by quantizing the frequency signal with the second quantizer scale and by coding the second quantizer scale and the quantized frequency signal according to a prescribed coding method, and wherein, in increasing the number of bits to be allocated, a difference between the third value and the second value or a ratio of the third value to the second value is calculated for the previous frame as the estimation error.

16. The non-transitory, computer-readable recording medium storing the audio coding computer program according to claim 15, wherein, in coding the frequency signal, a first quantizer scale by which reproduced sound quality meets the criterion and a second quantizer scale are determined for the previous frame, the second quantizer scale being determined so that a number of bits to be coded does not exceed the number of bits to be allocated, the number of bits to be coded being obtained by quantizing the frequency signal with the second quantizer scale and by coding the second quantizer scale and the quantized frequency signal according to a prescribed coding method, and wherein, in increasing the number of bits to be allocated, the estimation error takes a greater value as the second quantizer scale is greater than the first quantizer scale.

17. The non-transitory, computer-readable recording medium storing the audio coding computer program according to claim 16, wherein, in increasing the second value, the estimation error is corrected so that the estimation error takes a greater value as a quantization error is greater than an upper limit of power of the frequency signal for which a listener is not able to perceive deterioration of reproduced sound quality, the quantization error being caused when the frequency signal is quantized with the second quantizer scale in the coding the frequency signal in the previous frame.

18. The non-transitory, computer-readable recording medium storing the audio coding computer program according to claim 14, wherein the audio signal includes two or more channels, and wherein, in increasing the second value, the second value is set so that a total of the number of bits to be individually allocated to the two or more channels does not exceed an upper limit of a number of available bits.

19. The non-transitory, computer-readable recording medium storing the audio coding computer program according to claim 14, wherein, in increasing the second value, the second value is determined according to a value obtained by multiplying the first value of each of the at least one channel by an estimation coefficient determined for each of the at least one channel, and the estimation coefficient is updated when the estimation error is outside a prescribed allowable range over a prescribed number of frames, which is equal to or greater than 1.

* * * * *